US009114520B2

(12) United States Patent
Hirabayashi et al.

(10) Patent No.: US 9,114,520 B2
(45) Date of Patent: Aug. 25, 2015

(54) POWER TOOL

(75) Inventors: Shinji Hirabayashi, Anjo (JP); Tadasuke Matsuno, Anjo (JP)

(73) Assignee: MAKITA CORPORATION, Anjo (JP)

( * ) Notice: Subject to any disclaimer, the term of this patent is extended or adjusted under 35 U.S.C. 154(b) by 686 days.

(21) Appl. No.: 13/413,015

(22) Filed: Mar. 6, 2012

(65) Prior Publication Data

US 2012/0252623 A1 Oct. 4, 2012

(30) Foreign Application Priority Data

Mar. 31, 2011 (JP) ..... 2011-078039

(51) Int. Cl.

| | |
|---|---|
| ***E21B 3/00*** | (2006.01) |
| ***E21B 17/22*** | (2006.01) |
| ***E21B 19/16*** | (2006.01) |
| ***E21B 19/18*** | (2006.01) |
| ***B25F 5/00*** | (2006.01) |
| ***B24B 23/02*** | (2006.01) |
| ***B24B 47/12*** | (2006.01) |

(52) U.S. Cl.
CPC ..... *B25F 5/001* (2013.01); *B24B 23/028* (2013.01); *B24B 47/12* (2013.01)

(58) Field of Classification Search
CPC ..... B25F 5/001; B25B 21/00; B25B 23/141; B27B 17/08; F16H 15/50; F16H 3/44
USPC ..... 173/1–11, 217, 166–167, 171
See application file for complete search history.

(56) References Cited

U.S. PATENT DOCUMENTS

| | | | | |
|---|---|---|---|---|
| 3,552,628 | A * | 1/1971 | Hotchkiss et al. | 227/51 |
| 4,100,977 | A * | 7/1978 | Elliott | 173/207 |
| 4,513,827 | A * | 4/1985 | Dubiel | 173/178 |
| 4,540,318 | A | 9/1985 | Hornung et al. | |
| 4,643,046 | A | 2/1987 | Kaneyuki | |
| 5,816,121 | A * | 10/1998 | Yoshimizu et al. | 81/469 |
| 6,378,623 | B2 * | 4/2002 | Kawarai | 173/180 |
| 6,918,449 | B2 * | 7/2005 | Shinagawa et al. | 173/2 |
| 7,900,715 | B2 * | 3/2011 | Chen | 173/183 |

(Continued)

FOREIGN PATENT DOCUMENTS

| | | |
|---|---|---|
| DE | 10 2008 010 136 A1 | 8/2009 |
| JP | B2-03-73411 | 11/1991 |

(Continued)

OTHER PUBLICATIONS

Japanese Office Action issued in Japanese Patent Application No. 2011-078039 on Aug. 26, 2014 (with translation).

Aug. 23, 2012 Extended European Search Report issued in Application No. 12158941.0.

Feb. 26, 2013 European Patent Office Communication issued in European Patent Application No. 12158941.0.

*Primary Examiner* — Robert Long
(74) *Attorney, Agent, or Firm* — Oliff PLC

(57) ABSTRACT

Embodiments of the present invention may include a power tool having a driving motor, a spindle with a front tool and a continuously variable transmission mechanism. The driving motor is configured to output any number of output rotations. The continuously variable transmission mechanism is configured to shift the number of rotations from the driving motor in any ratio and output the shifted rotation to the spindle. The driving motor changes the number of output rotations. The continuously variable transmission mechanism changes the ratio. Both the driving motor and the continuously variable transmission mechanism serve to alter the rotational speed of the spindle.

4 Claims, 9 Drawing Sheets

(56) References Cited

U.S. PATENT DOCUMENTS

| | | | | |
|---|---|---|---|---|
| 8,607,891 | B2 * | 12/2013 | Kondo | 173/176 |
| 2007/0007024 | A1 * | 1/2007 | Tokairin et al. | 173/48 |
| 2011/0108600 | A1 * | 5/2011 | Pedicini et al. | 227/2 |
| 2012/0157257 | A1 * | 6/2012 | Hirabayashi et al. | 475/159 |
| 2012/0165152 | A1 * | 6/2012 | Tokunaga et al. | 475/159 |
| 2012/0231924 | A1 * | 9/2012 | Monteiro De Lima | 475/344 |
| 2012/0247247 | A1 * | 10/2012 | Matsuno et al. | 74/417 |
| 2012/0247799 | A1 * | 10/2012 | Hirabayashi et al. | 173/213 |
| 2012/0286014 | A1 * | 11/2012 | Pedicini et al. | 227/4 |

FOREIGN PATENT DOCUMENTS

| | | | | |
|---|---|---|---|---|
| JP | A-06-190740 | | 7/1994 | |
| JP | A-7-97141 | | 4/1995 | |
| JP | A-2002-059370 | | 2/2002 | |
| JP | 2003145447 | A * | 5/2003 | B25F 5/00 |
| JP | A-2003-145447 | | 5/2003 | |

* cited by examiner

POWER TOOL

This application claims priority to Japanese patent application serial number 2011-78039, the contents of which are incorporated herein by reference.

BACKGROUND OF THE INVENTION

1. Field of the Invention

The present invention relates to a power tool, such as a disc grinder, an electric screwdriver, or a drill for boring, which is equipped with an electric motor therein as a power source.

2. Description of the Related Art

Such a power tool is generally equipped with either a gear train for changing the number of output revolutions of a motor or a gear train for changing the output direction. A CVT (Continuously Variable Transmission) that continuously varies the gear train and reduction ratio is commonly used as a transmission mechanism for power tools. Technology concerning CVT traction drives are disclosed, for example, in JP No. 6-190740 A, JP No. 2002-59370 A, and JP No. 3-73411 B2.

In a continuously variable transmission traction drive, a plurality of conical planetary rollers are supported by a holder. A centrally located sun roller is pressed onto the planetary rollers. A shift ring located around the holder is pressed onto the planetary rollers. Through rolling contact, planetary rollers transmit rotational power to an output shaft. The number of output revolutions is continuously altered due to the changing of the position of the shift ring relative to the planetary rollers. The pressing position of the shift ring pressed to the conical surfaces of the planetary rollers is varied between a small diameter and a large diameter.

A screw-tightening tool equipped with a continuously variable transmission therein is disclosed in JP 6-190740 A. In the screw-tightening tool, it is possible to continuously vary the speed and torque output. This is accomplished by moving a shift ring. In creating low speed/high torque output, thread-fastening can be easily performed.

Embodiments of a power tool that varies the number of rotations of a driving motor by using a reduction mechanism having a fixed reduction ratio are disclosed. They typically include a sequential transmission mechanism or a continuously variable transmission mechanism, which uses a gear train, and transmits rotation to a front tool.

When an electric disc grinder is used, it may be preferable that the grindstone be rotated at a low speed in order to prevent the scattering of grinding powder and grind water. In other situations it is difficult to create a large reduction ratio in transmission mechanisms.

Therefore, there exists the need to create a power tool, such as a disc grinder, having a large transmission width relative to the gear train. Alternatively, a transmission traction drive mechanism is desired.

SUMMARY OF THE INVENTION

Embodiments of the present invention include a power tool having a driving motor, a spindle with a front tool and a continuously variable transmission mechanism. The driving motor is configured to output any number of rotations. The continuously variable transmission mechanism is configured to shift the number of rotations in the driving motor and output that amount to the spindle. When the continuously variable transmission mechanism changes the output ratio, the driving motor changes the output rotation. When this occurs, the rotational speed of the spindle is adjusted.

In such a configuration, the spindle can have a large transmission width.

DETAILED DESCRIPTION OF THE INVENTION

Figure 1:
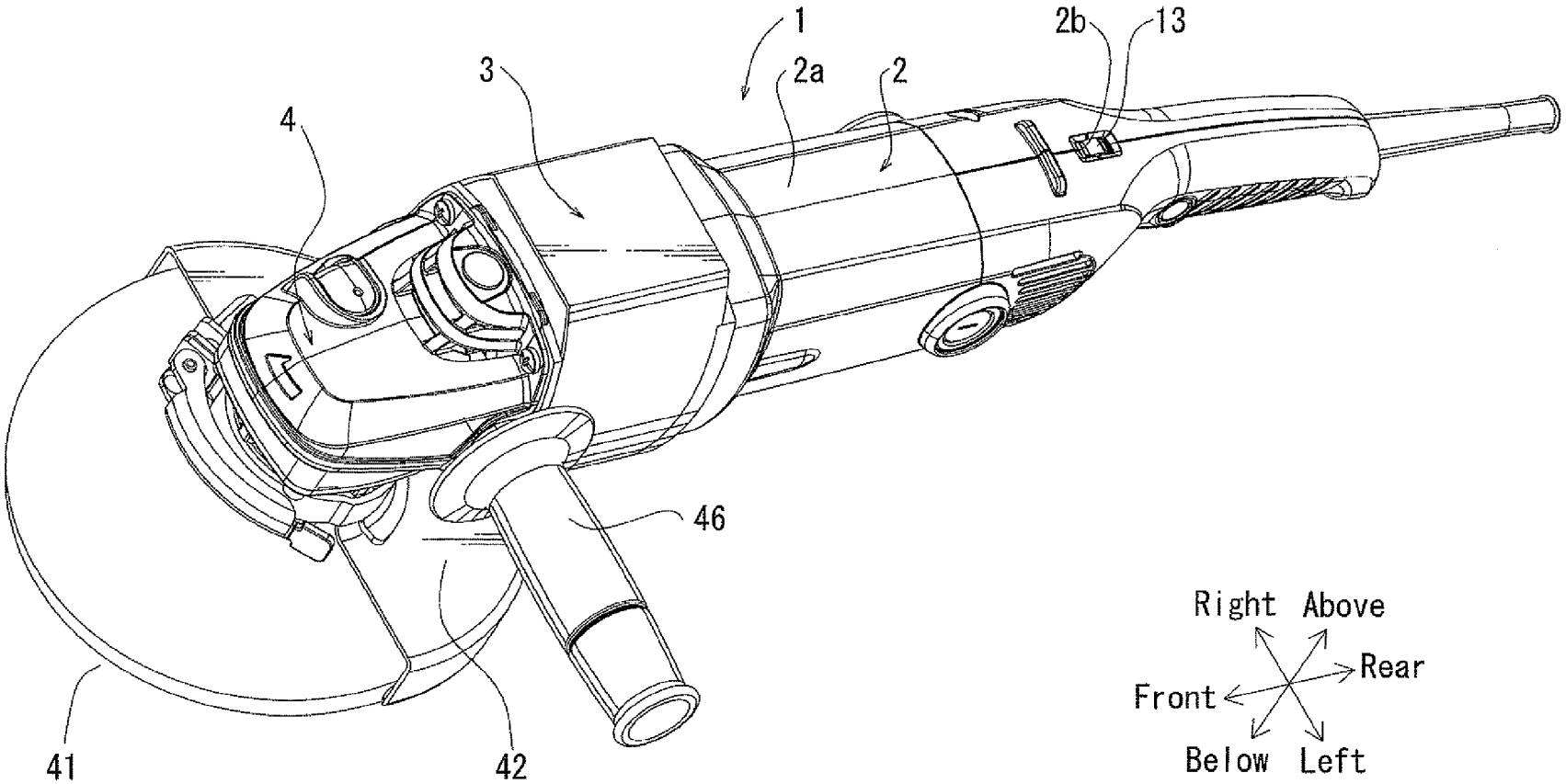
FIG. 1 is a perspective view of a disc grinder.

Each of the additional features and teachings disclosed above and below may be utilized separately or in conjunction with other features and teachings to provide improved power tools. Representative examples of the present invention, which utilize many of these additional features and teachings both separately and in conjunction with one another, will now be described in detail with reference to the attached drawings. This detailed description is merely intended to teach a person of ordinary skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful configurations of the present teachings.

Embodiments of the present invention are described with respect to basis of FIGS. 1 to 23. The power tool of the embodiment described below is an example of a disc grinder 1. The disc grinder 1 generally includes a tool main body 2, a shifting portion 3, and a gear head portion 4. A circular grindstone 41 is mounted on a spindle 40 protruding downward from the bottom of the gear head portion 4. A grind stone cover 42 for preventing grind dust from scattering is mounted at the rear half of the grind stone 41.

In the tool main body 2, a motor 10 is used as a drive source in a cylindrical main body case 2*a*. The main body case 2*a* may also serve as a handle for a user. A cooling fan 12 is fitted on an output shaft 11 of the motor 10. External air is suctioned from the rear portion of the tool main body 2 by rotation of the cooling fan 12 and moved to the front portion of the tool main body 2*c* The air serves to cool the drive motor 10. The output shaft 11 of the drive motor 10 is rotatably supported inside the main body case 2*a* by bearings 11*a* and 11*b*.

The rotational output of the drive motor 10 is transmitted to the spindle 40 through the continuously variable transmission mechanism 30 and the gear head portion 4. The number of revolutions of the output shaft 11 of the drive motor 10 is altered by the shifting portion 3. The shifting portion 3 includes a continuously variable transmission mechanism 30 and a shift control portion 20 for controlling the continuously variable transmission mechanism 30. The shifting portion 3 is located in a transmission case 3*a* connected to the front portion of the tool main body 2.

The continuously variable transmission mechanism 30 is preferably a three-point pressure type which includes a centrally-located sun roller 32 fitted on the output shaft 11 of the motor 10. It may also contain a plurality (three in the embodiment) of planetary rollers 33 having a conical surface 33*b*, a push roller 34 pressed to the planetary rollers 33, a pressure-adjusting cam mechanism 35 for transmitting a pushing force to the push roller 34 and shift rings 36 having an inner circumference pressed to the conical surfaces 33*h* of the planetary rollers 33.

In the three-point pressure continuously variable transmission mechanism, the planetary rollers 33 rotate about the center axis and revolve around the sun roller 32 in the same direction as the rotation of the sun roller 32. The push roller 34 rotates in the opposite direction of the rotation of the sun roller 32.

The three-point pressure continuously variable transmission mechanism 30 includes a sun roller 32 fitted on the output shaft 11 of the drive motor 10, a plurality of (three in the embodiment) planetary rollers 33 having a conical surface 33*b*, a push roller 34 pressed to the planetary rollers 33, a pressure-adjusting cam mechanism 35 for generating a pushing force to the push roller 34 and shift rings 36 having an inner circumference pressed to the conical surfaces 33*b* of the planetary rollers 33.

The sun roller 32 is fitted at the front-end portion of the output shaft 11 of the drive motor 10. The sun roller 32 may be rotatably supported by the bearing 32*a* in the transmission case 3*a*. The sun roller 32 may then be pressed to the heads of the three planetary rollers 33.

The rear portion of the output shaft 31 is rotatably supported by the bearing 32*b* fitted on the sun roller 32. The sun roller 32 and the output shaft 31 are coaxially positioned with the output shaft 11 of the motor 10.

The front portion of the output shaft 31 is rotatably supported in the front portion of the transmission case 3*a* by the bearing 31*b*. The front portion of the output shaft 31 protrudes from the inside of the transmission case 3*a* to the inside of the gear head portion 4. A bevel gear 43 of the driving side is mounted at the front end of the output shaft 31.

The three planetary rollers 33 are supported by support shaft portions 33*a* and are inserted in support holes 37*e* formed at three positions with regular intervals in the circumferential direction of the holder 37. The three planetary rollers 33 are supported to be rotatable about the pivot axes of the support shaft portions 33*a* with respect to the holder 37. The planetary roller 33 is supported with the rotational axis (support shaft portion 33*a*) inclined at a predetermined angle from the vertical position (position perpendicular to the output shaft 31).

The push roller 34 is supported by the output shaft 31 whereby it may be rotated, axially displaced, and be pressed against the planetary rollers 33. The holder 37 is rotatably supported with respect to the transmission case 3*a* through a boss portion 34*a* disposed on the rear surface of the push roller 34. The pressure-adjusting cam mechanism 35 is disposed on the side of the front surface of the push roller 34.

The pressure-adjusting cam mechanism 35 may include a plurality of steel balls 39 interposed between the front surface of the push roller 34 and a pressing plate 38. Each of the steel balls 39 is fitted in cam grooves formed on the front surface of the push roller 34 and the rear surface of the pressing plate 38. A compressing spring 35*a* is disposed between the push roller 34 and the pressing plate 38. The pressing plate 38 is pressed to a flange portion 31*a* of the output shaft 31 and the axial movement is restricted by the compressing spring 35*a*. The pressing plate 38 is coupled to the output shaft 31 by a key 31*c*. The pressing plate preferably integrally rotates with the output shaft 31.

When a rotational load is applied to the output shaft 31, rotation is generated between the push roller 34 and the pressing plate 38, such that the steel balls 39 are moved to the shallow side of the cam groove by an external force. Eventually the force that presses the push roller 34 to the planetary roller 33 increases. The push roller 34 is pressed against each of the planetary rollers 33 by the external force and the biasing force of the compressing spring 35*a*. The sun roller 32 is pressed to the head of each of the planetary rollers 33 and the shift ring 36 is pressed to the conical surface 33*b* of each of the planetary rollers 33 by the same force.

The motor 10 rotates the sun roller 32 which thereby rotate the planetary rollers 33 about the pivot axis. The planetary rollers 33 revolve around the output shaft 31 while being supported by the holder 37. As the planetary rollers 33 revolve around the output shaft 31, the push roller 34 integrally rotates with the holder 37.

When the push roller 34 rotates, the output shaft 31 integrally rotates via the pressure-adjusting cam mechanism 35. When the motor 10 is started, rotational power is transmitted to the spindle 40 through the continuously variable transmission mechanism 30 in the three-point pressing state. This power is used by a reduction gear train 45 of the gear head portion 4, to rotate a grindstone 41.

A bevel gear 43 of the driving side of the gear head portion 4 is fitted on the output shaft 31 of the continuously variable transmission mechanism 30. A bevel gear 44 of the receiving side is engaged with the bevel gear 43. The bevel gear 44 may be fitted on the spindle 40. The reduction gear train 45 with a constant reduction ratio may be composed of the engaged bevel gears 43 and 44. The spindle 40 lies perpendicular to the output shaft 31 of the continuously variable transmission mechanism 30 (output shaft 11 of the drive motor 10) and next to the reduction gear train 45. The output shaft 31 of the continuously variable transmission mechanism 30 is coaxially positioned with the output shaft 11 of the motor 10.

As shown in FIG. 1 a side grip 46 protrudes in a side direction at the left side of the gear head portion 4. A user holds the tool main body 2 with the right hand and holds the side grip 46 with the left hand.

During power transmission between the spindle 40 and the grindstone 41, the shift ring 36 of the continuously variable transmission mechanism 30 may be positioned at an area on the planetary rollers 33 having a small diameter. When this occurs, the revolving speed of the planetary rollers 33 decreases, the rotation speed of planetary rollers 33 increases, and the rotational speed of the push roller 34 increases. For clarification, the "revolving speed" refers to the speed about which the planetary rollers revolve about the output shaft 31, while "rotational speed" refers to the speed about which they rotate about their own axis. In this way the reduction ratio of the continuously variable transmission mechanism 30 decreases and the spindle 40 rotates at a high speed.

When the shift ring 36 is positioned at an area of the planetary rollers 33 having a large diameter, the revolving speed of the planetary rollers 33 increases, the rotation speed of planetary rollers 33 decreases and the rotation of the push roller 34 decreases. In this way the reduction ratio of the continuously variable transmission mechanism 30 increases and the spindle 40 rotates at a low speed.

Figure 6:
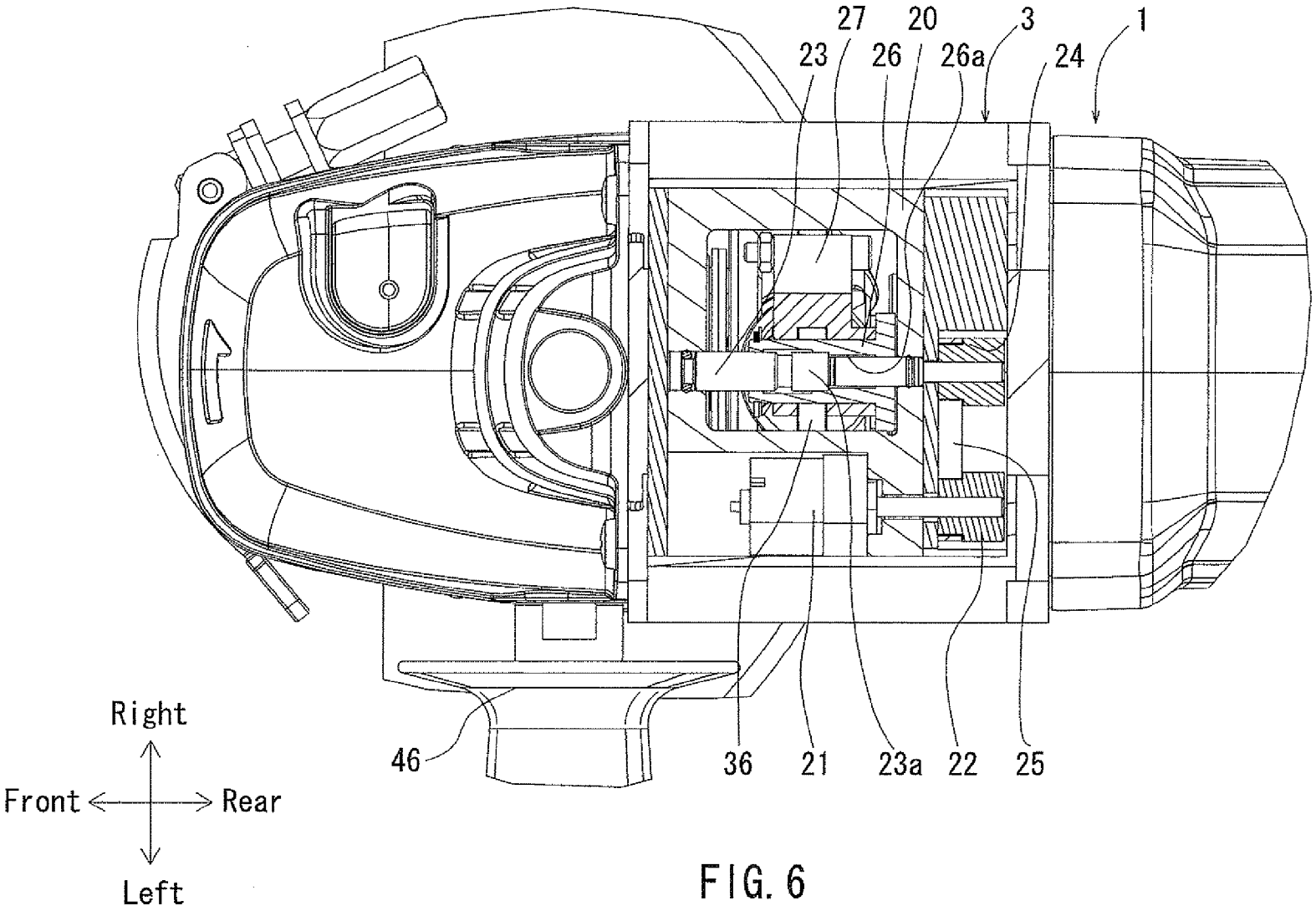
FIG. 6 is a plain view of a front portion of the disc grinder showing a cross-sectional view of the shift control position taken along line VI-VI in FIG. 2.

The shifting portion 3 includes a shift control portion 20 for shifting the continuously variable transmission mechanism 30. The shift control portion 20 is disposed at the upper portion of the shifting portion 3, on the outer circumference of the shift ring 36. The shift control portion 20, as shown in FIG. 6, includes a shift motor 21, a drive pulley 22 fitted on the output shaft of the shift motor 21, an operation shaft 23 disposed in parallel with the output shaft of the shift motor 21, a receiving pulley 24 fitted on the operation shaft 23 and a driving belt 25 held around the drive pulley 22 and the receiving pulley 24. When the shift motor 21 starts, the operation shaft 23 rotates about the pivot axis by movement of the drive belt 25.

A threaded portion 23*a* is formed on the operation shaft 23. An operation sleeve 26 is fitted on the circumference of the operation shaft 23. The threaded portion 23*a* of the operation shaft 23 is fastened in a threaded hole 26*a* of the operation sleeve 26. When the operation shaft 23 rotates about the pivot axis, the threaded portion 23*a* moves along the threaded hole 26*a*, such that the operation sleeve 26 moves in the axial direction (left-right direction in FIG. 6) of the operation shaft 23. A bifurcated operation arm 27 is disposed on the operation sleeve 26, preferably immovably, in the forward direction with respect to the operation sleeve 26. The upper portion of the shift ring 36 is interposed and fitted inside the bifurcated portion of the operation arm 27 axially from both sides. Accordingly, when the operation sleeve 26 is moved in the left-right direction by rotation of the operation shaft 23 in FIG. 6, the shift ring 36 moves in parallel to a low speed side or a high-speed side in internal contact to the three planetary rollers 33.

The shift control portion 20 is disposed in the continuously variable transmission mechanism 30. When the shift motor 21 of the shift control portion 20 starts at the high-speed side and the operation shaft 23 is rotated, the shift ring 36 moves to the high-speed sides (low diameter side) of the planetary rollers 33, such that the reduction ratio decreases. As a result, the spindle 40 and the grindstone 41 are rotated at a high speed (the number of rotations increases). On the contrary, when the shift motor 21 of the shift control portion 20 is started at the low speed side and the operation shaft 23 is rotated backward, the shift ring 36 moves to the low speed sides (large diameter side) of the planetary rollers 33, such that the reduction ratio increases. As a result, the number of revolutions of the spindle 40 and the grind stone 41 decreases and they rotate slowly.

The operations of the drive motor 10 and the shift motor 21 are controlled by a motor control portion.

Figure 2:
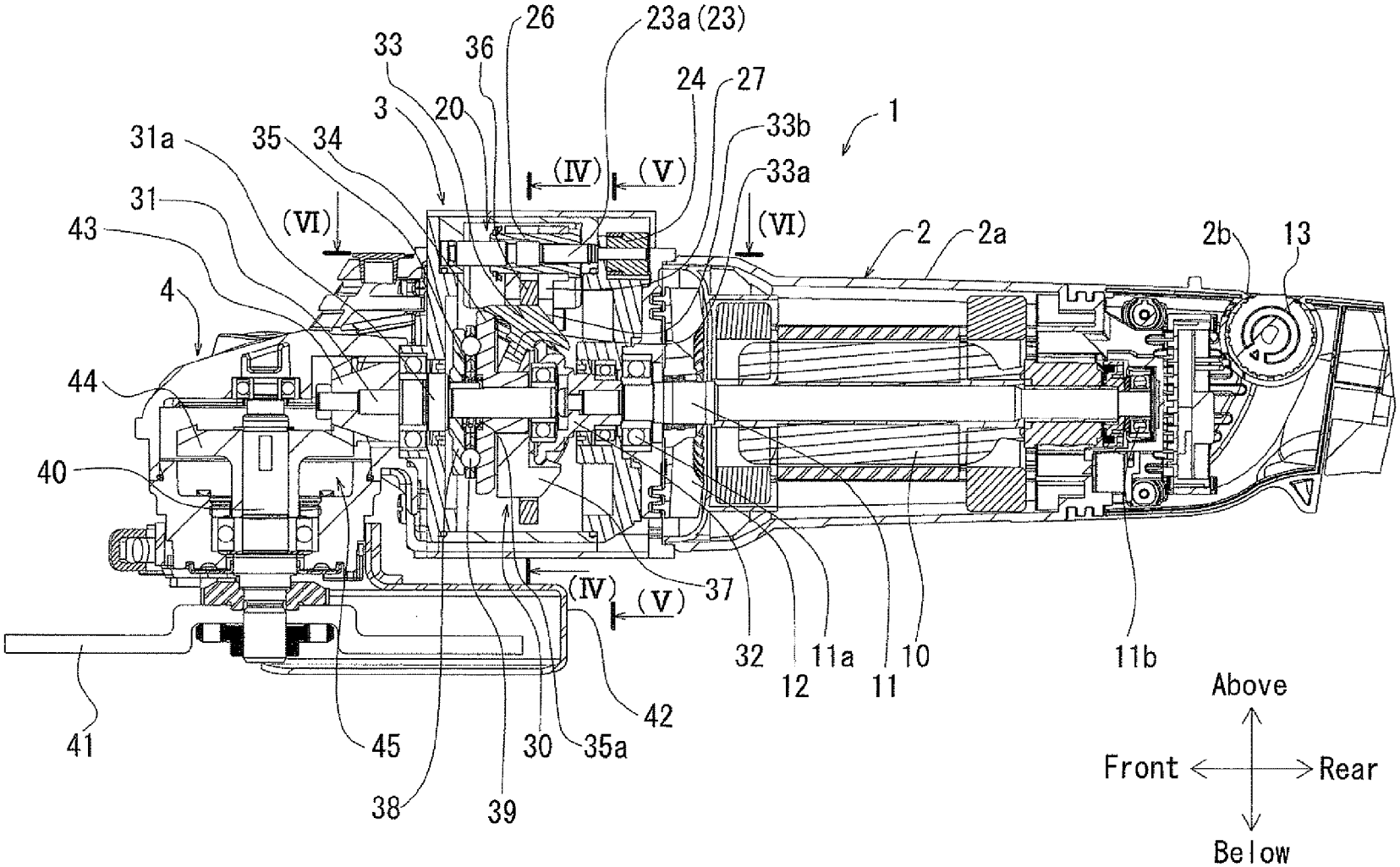
FIG. 2 is a cross-sectional view of an inner mechanism of a disc grinder.

The shift control portion 20, which controls the position of the shift ring 36, via the shift motor 21 is activated in accordance with the operation state of an operation member 13. As shown in FIGS. 1 and 2, the operation member 13 is disposed on the upper surface of the rear portion of the main body 2. The operation member 13 may be, for example, a disc-shaped dial. The upper portion of the operation member 13 protrudes towards the window portion 2*b* disposed on the main body case 2*a*. The operation member 13 is turned by operation of the upper portion.

Figure 7:
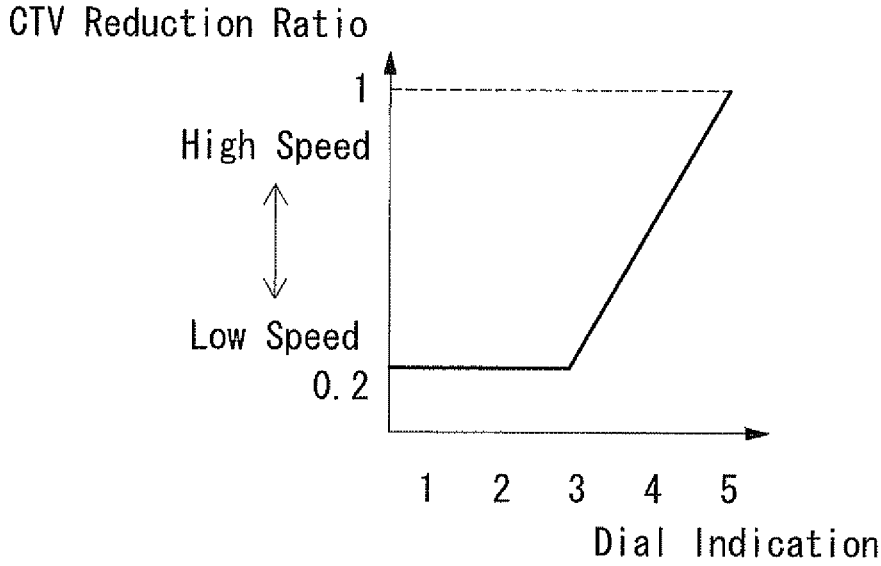
FIG. 7 is a graph showing a continuously variable transmission with respect to a dial indicator.
Figure 8:
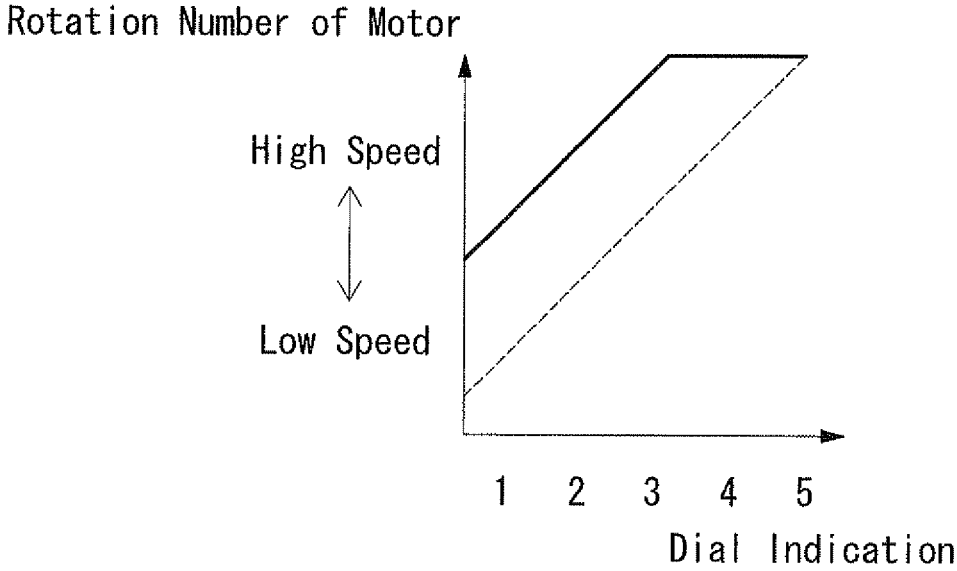
FIG. 8 is a graph showing the condition of a drive motor with respect to the dial indicator.
Figure 9:
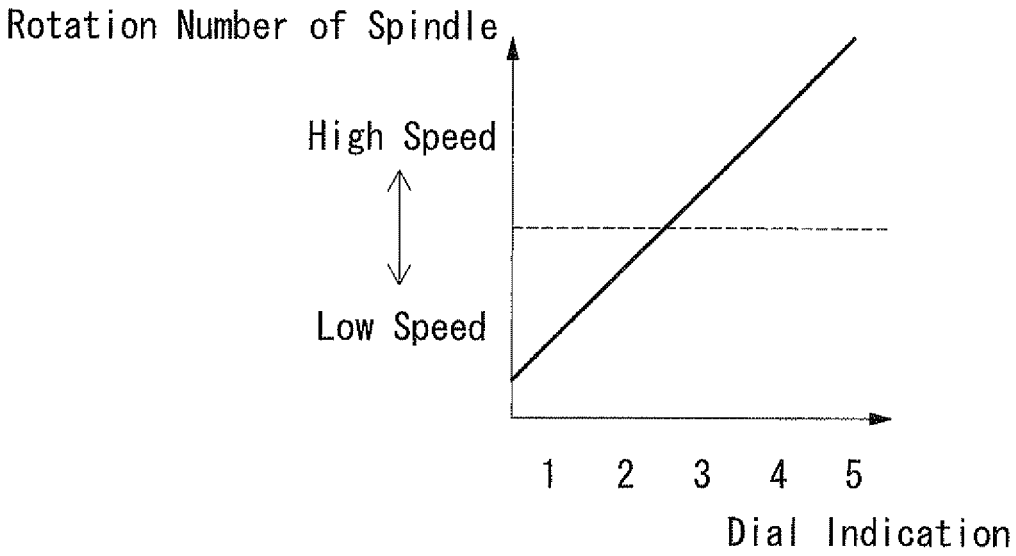
FIG. 9 is a graph showing the condition of a spindle with respect to the dial indicator.

Five-stepped indications "1" to "5" may be disposed on the outer circumference of the operation member 13. When the operation member 13 is operated and turned on, an indication signal is input to the motor control portion. Activation serves to regulate the number of revolutions of the drive motor 10. Activating the motor 10, also activates the shift motor 21 of the shift control portion 20. FIG. 7 shows a change in the reduction ratio of the continuously variable transmission mechanism 30 through the operation of the operation member 13. FIG. 8 shows a change in the number of revolutions of the drive motor 10 through operation of the operation member 13. FIG. 9 shows a change in the number of revolutions of the spindle 40 through operation of the operation member 13.

Figure 3:
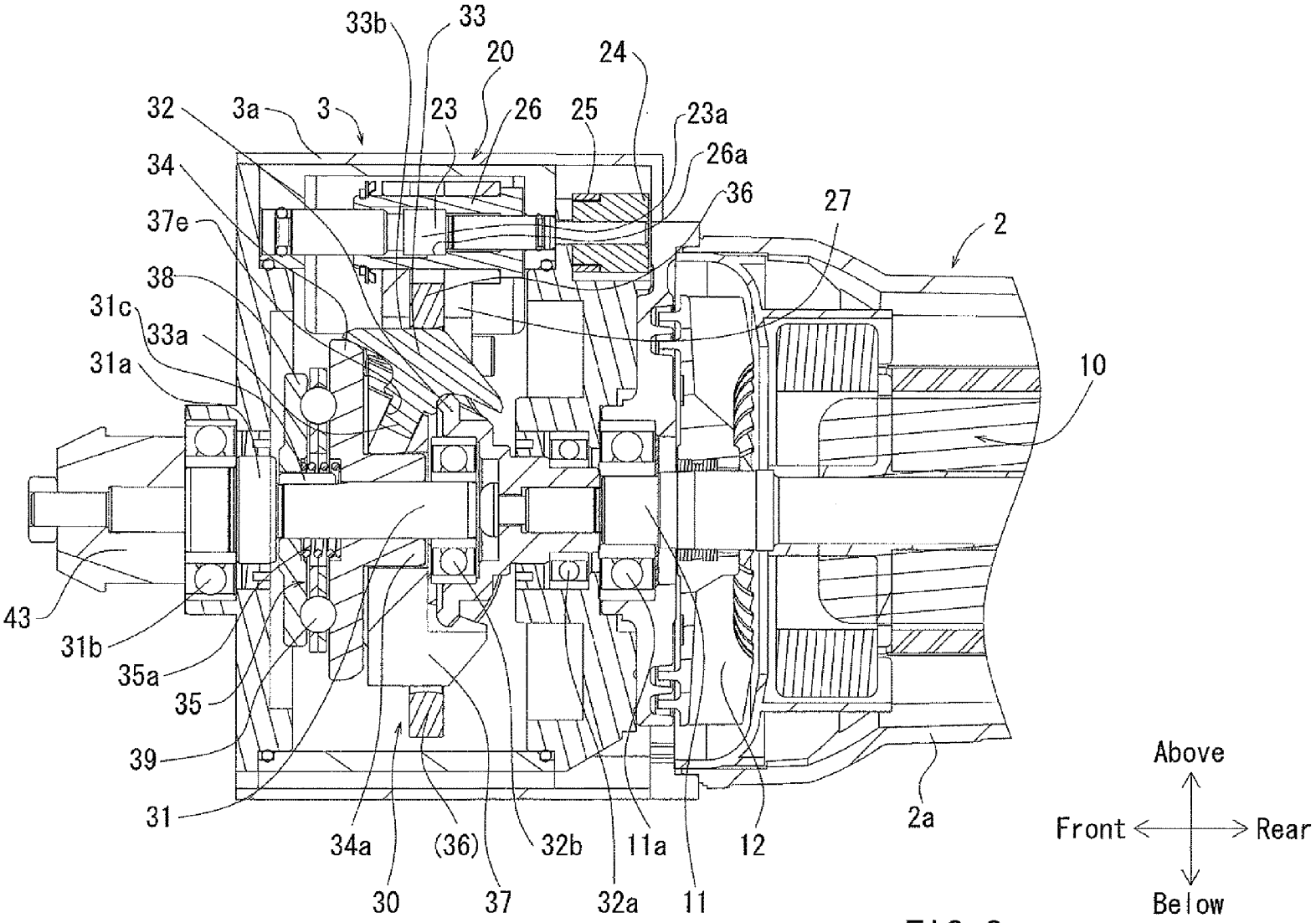
FIG. 3 is an exploded view of a shifting portion.
Figure 4:
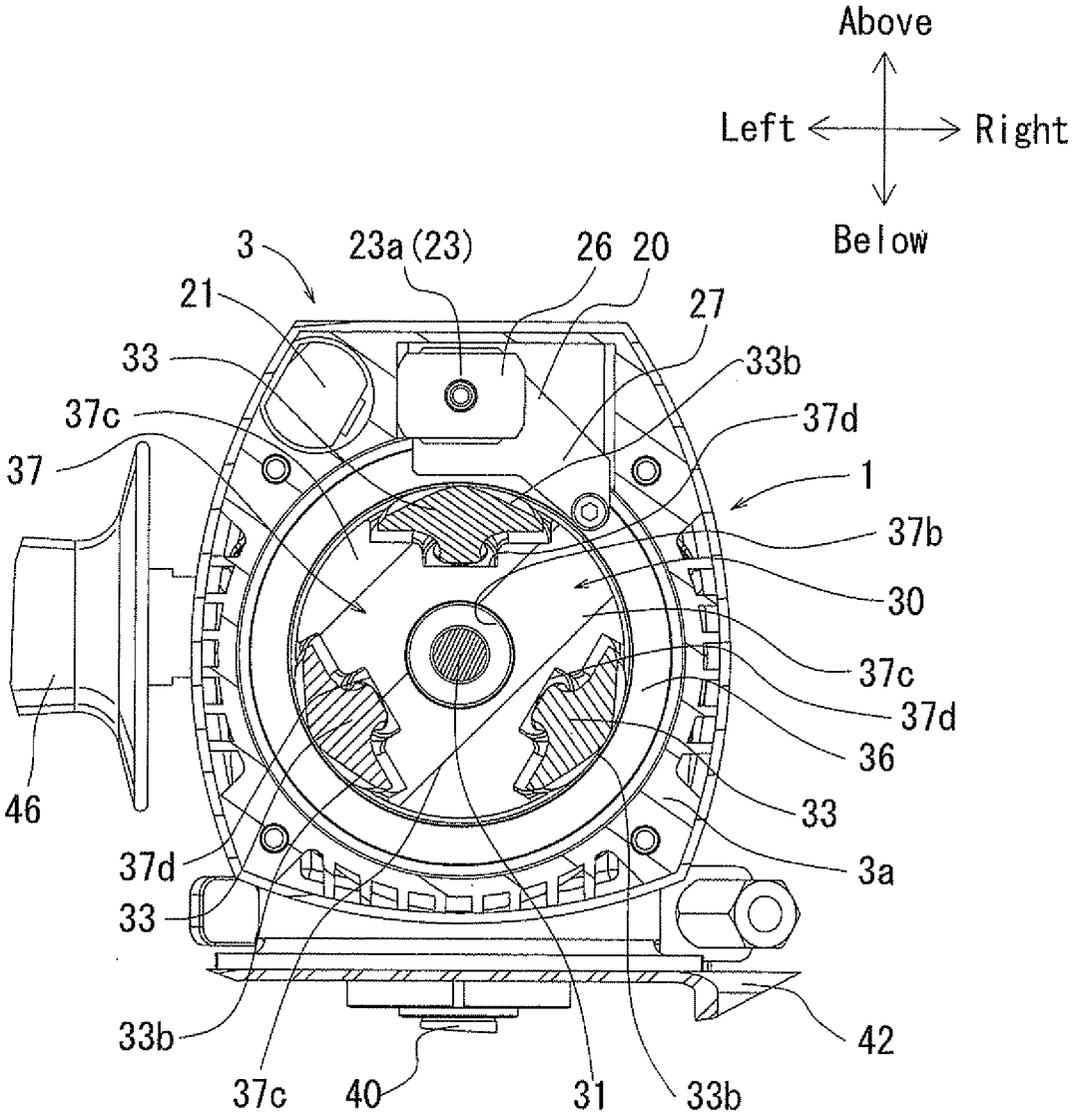
FIG. 4 is a cross-sectional view of the shifting portion taken along line IV-IV in FIG. 2.
Figure 5:
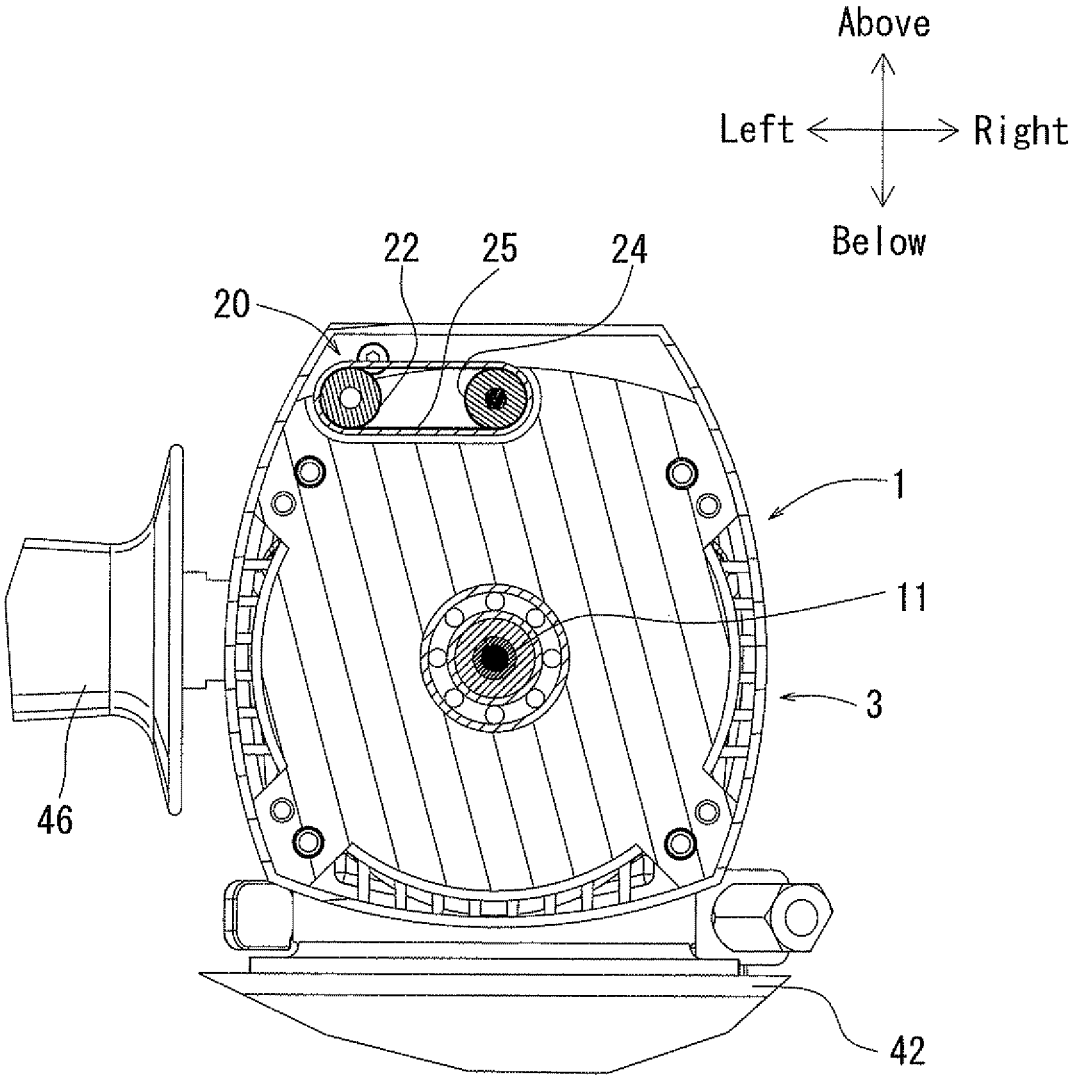
FIG. 5 is a cross-sectional view of a shift control portion taken along line V-V in FIG. 2.

As shown in FIG. 7, when the operation member 13 is positioned within the indicators "1" to "3", the shift motor 21 of the shift control portion 20 is started at the low speed side and the shift ring 36 is positioned at the large diameter side of the planetary rollers 33. Accordingly, the reduction ratio of the continuously variable transmission mechanism 30 is maintained at about 0.2 (low speed side). When the operation member 13 is positioned within the indicators "3" to "5", the shift motor 21 is started at the high speed side in accordance with the position and the shift ring 36 is moved to the low diameter side of the planetary rollers 33, as shown in FIGS. 2 and 3. Therefore, the reduction ratio of the continuously variable transmission mechanism 30 continuously increases in accordance with the position of the operation member 13 and becomes about 1.0 (high speed side) at the indicator "5".

As shown in FIG. 8, when the operation member 13 is positioned within the indicators "1" to "3", the number of output revolutions of the drive motor 10 continuously varies in accordance with the position of the operation member 13. When the operation member 13 is positioned at the indicator "1", the number of output revolutions of the drive motor 10 is set to a minimum. The low speed in the indicator "1" can be shifted to a higher speed. Therefore, as shown by a dotted line in FIG. 8, when this occurs, a large reduction in output torque does not occur. When the operation member 13 is positioned within the indicators "3" to "5", the number of output revolutions of the drive motor 10 becomes the maximum number of revolutions while the output torque of the drive motor 10 reaches maximum full power.

When the operation member 13 is adjusted between "1" and "5" reduction ratio of the continuously variable transmission mechanism 30 and the number of output revolutions of the drive motor 10 are modified. The reduction ratio and the number of output revolutions are output to the spindle 40. Accordingly, as shown in FIG. 9, it is possible to continuously vary the number of revolutions of the spindle 40 in a large shift width in accordance with the position of the operation member 13. Further, even in the low speed section, the number of output revolutions of the drive motor 10 can be maintained at a high speed, such that it is possible to keep the rotational torque (machining force) of the spindle 40 and the grind stone 41 high.

Therefore, when the operation member 13 is turned within the indications "1" to "3", the continuously variable transmission mechanism 30 is shifted to a reduction ratio within a low speed section. Also, the number of output rotations of the driving motor 10 is shifted to or above the middle speed section. Therefore, it is possible to rotate the spindle 40 and the grindstone 41 with a large reduction ratio without losing a significant amount of power.

Accordingly, in the power tool 1, the shift by the continuously variable transmission mechanism 30 and the shift of the drive motor 10 are output to the spindle 40. For this configuration, the shift width of the power tool 1 can be set to a large level.

In the low speed section of the spindle 40, it is possible to keep the number of output revolutions of the drive motor 10 on a high-speed side by adjusting the continuously variable transmission mechanism 30. Accordingly, it is possible to avoid large reductions in power down in the low speed section. When shifting the continuously variable transmission mechanism 30 to a low speed, the number of revolutions of the motor is reduced and one can rotate the spindle 40 with a large reduction ratio. Alternatively, shifting the continuously variable transmission mechanism 30 to a high speed, the number of revolutions is increased and the spindle 40 can rotate with a small reduction ratio.

In a continuously variable transmission mechanism 30 traction drive, a lubricant (for example, traction oil or traction grease) for forming an oil layer for power transmission may be applied to the sun roller 32, the push roller 34 and the shift ring 36. The transmission case 3*a* may be filled with an appropriate amount of lubricant. Each part of the transmission case 3*a* is sealed to prevent leakage of the lubricant. When the power tool 1 is used, the lubricant is stored in the lower portion in the transmission case 3*a* may be contacted mainly by the three planetary rollers 33 and the holder 37, such that the lubricant is applied to each of the pressing portions.

Stirring resistance of the lubricant may be generated during power transmission when the holder 37 is rotated and the planetary rollers 33 revolve. The stirring resistance of the lubricant effectively adds to the resistance of the planetary rollers 33, the rotational resistance of the holder 37, and the rotational resistance of the output shaft 31 of the continuously variable transmission mechanism 30. This, in turn, generates a loss of torque in the power transmission system.

The stirring resistance of the lubricant causes a decrease of the rotational torque of the spindle 40, such that the current load of the drive motor 10 increases. The planetary rollers 33 radially surrounding the holder 37 create stirring resistance. In order to reduce the stirring resistance of the lubricant in the embodiment, the holder 37 is provided with resistance reducing portions for filling the gaps between adjacent planetary rollers 33.

Figure 10:
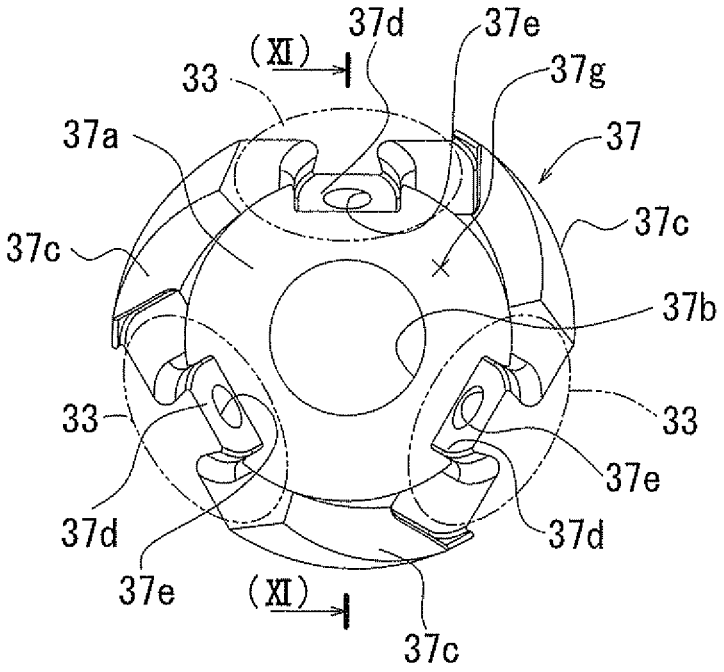
FIG. 10 is a rear view of a holder.
Figure 11:
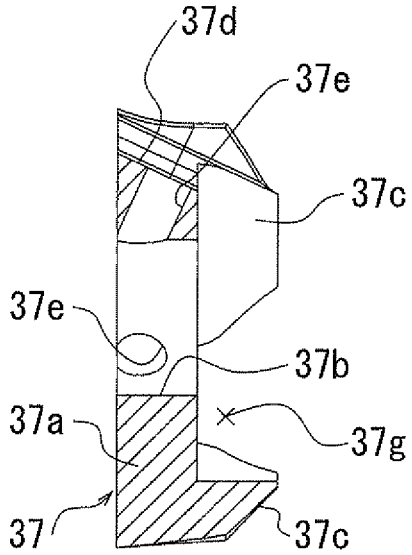
FIG. 11 is a cross-sectional view taken along line XI-XI in FIG. 10.

As shown in FIGS. 10 and 11, the holder 37 has a disc-shaped base 37*a*. An insertion hole 37*b* for inserting the output shaft 31 is formed at the center of the base 37*a*. Flat roller support seats 37*d* for supporting each of the planetary rollers 33 are formed at three positions around the circumference of the base 37*a*. One support hole 37*e* is formed at the center of the roller support seat 37*d*. The shaft support portion 33*a* of the planetary roller 33 is inserted in the support hole 37*e*, such that each of the planetary rollers 33 is able to rotate about the pivot axis of the support shaft portion 33*a*.

The resistance reducing portions 37*c* are formed at both sides of each of the roller support seats 37*d*. They are preferably arranged such that they do not interfere with the rotation of the planetary rollers 33 when they rise up from the edge of the base 37*a*. The resistance reducing portion 37*c* slightly rises up with respect to the conical surface 33*b* of the planetary roller 33. It is preferred that the resistance reducing portion 37*c* may rise up such that it does not interfere with the inner circumferential surface of the shift ring 36. The resistance reducing portion 37*c* protrudes radially outward from both sides of the roller support seat 37*d* and extends towards the sun roller 32.

The outer circumferential surface of the resistance reducing portion 37*c* is cut in a polygonal shape to avoid interference with the shift ring 36.

The resistance reducing portions 37*c* fill the gaps between the planetary rollers 33 around the holder 37. The assembly of the holder 37 and the planetary rollers 33 generally has shape with small concavities and convexities in the circumferential direction. In this configuration, the lubricant scraping resistance is reduced during revolution of the assembly.

Further, the loss of output torque of the spindle 40 may be reduced and the current load of the drive motor 10 can be prevented from increasing.

The reduction in scraping resistance is particularly useful with a high viscosity lubricant. It can reduce the resistance during high-speed rotation.

The resistance reducing portions 37*c* fill the gaps between two planetary rollers 33. The gaps between the resistance reducing portions 37*c* and the planetary rollers 33 are reduced such that they do not interfere with each other. When traction grease is used as the lubricant for the continuously variable transmission mechanism 30, the narrow space between the planetary roller 33 and the resistance reducing portion 37*c* can function to store grease. In such a manner, the pressing portions can stay lubricated.

The resistance reducing portions 37*c* may extend towards the sun roller 32. Therefore, as shown in FIG. 11, a space 37*g* surrounded by the resistance reducing portions 37*c* is formed at the three positions on the drive side of the base 37*a*. The space 37*g* can function as a grease storage location.

The space 37*g* may serve to hold grease to keep the planetary rollers 33 lubricated. During rotation of the planetary rollers 33, this space 37*g* also functions to prevent scattering of the grease from the holder.

Figure 12:
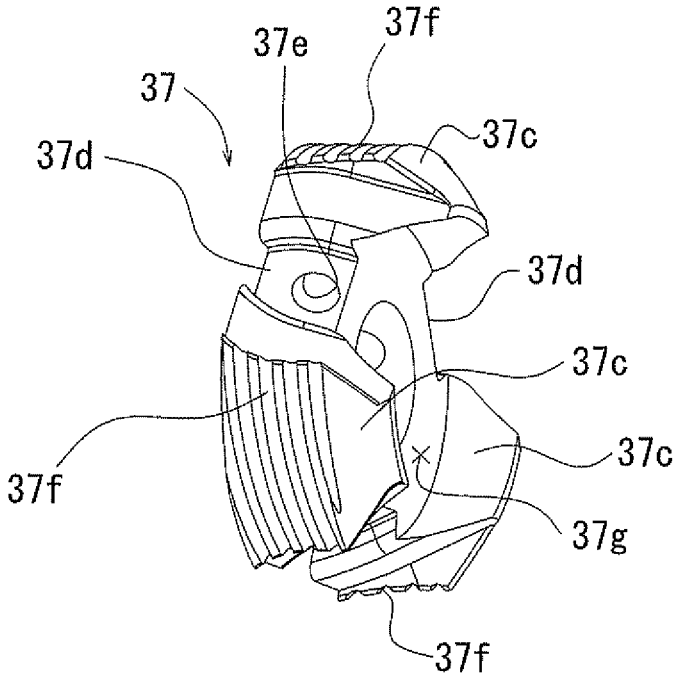
FIG. 12 is an embodiment of a holder provided with a scraping groove.

As shown in FIGS. 10 and 11, the circumferential surfaces of the resistance reducing portions 37*c* of the holder 37 have a smooth shape. Such shapes ensure minimal lubricant scraping resistance. As shown in FIG. 12, a plurality of scraping grooves 37*f* may be formed on the circumferential surfaces of the resistance reducing portions 37*c* of the holder 37.

The scraping grooves 37*f* are disposed along a spiral path in the inclined direction with respect to the rotational axis of the holder 37. Scraping grooves 37*f* may be formed in the rotational direction of the holder 37. When the holder 37 rotates, the scraping grooves 37*f* serve to reduce scraping resistance. Compared to a holder without the resistance reducing portions 37*c*, this holder 37 efficiently guides lubricant along the inside of the scraping grooves 37*f* to increase upward scraping and reduce scraping resistance.

As a power tool 1, a disc grinder is generally used in a position with the grindstone 41 facing down at an angle. In such a situation, the lubricant gathers at the front portion of the transmission case 3*a*, but it is scraped rearward and upward at an angle by the scraping grooves 37*f* disposed on the circumferential surface of the rotating holder 37. In this fashion, the lubricant is more uniformly supplied to the planetary rollers 33.

The power tool 1 described above comprises the driving motor 10, the spindle 40 with a front tool (the grindstone 41), and the continuously variable transmission mechanism 30. The driving motor 10 is configured to output any number of output rotations. The continuously variable transmission mechanism 30 is configured to shift the number of rotations from the driving motor 10 in any ratio and output the shifted number of rotations to the spindle 40. The driving motor 10 changes the number of the output rotations while the continuously variable transmission mechanism 30 changes the ratio. Together, they change the rotational speed of the spindle. In other words, the power tool 1 uses both the continuously variable transmission mechanism 30 and the transmission of the driving motor 10. In this configuration, the transmission width of the spindle 40 can be large.

A single operation member 13 may be configured to change the number of the output rotations of the driving motor 10, as well as the ratio of the continuously variable transmission mechanism 30. A power tool 1, with such a configuration can use a single operation member 13 for making multiple adjustments.

The power tool 1 typically has a low speed section of the spindle 40 and a high-speed section of the spindle 40. The rotational speed of the spindle 40 in the high-speed section is higher than the rotation speed in the low speed section. Reduction of the continuously variable transmission mechanism 30 has priority over reduction of the driving motor 10 when the rotational speed of the spindle 40 is reduced in the high-speed section. The reduction of the driving motor 10 reduces the rotation speed of the spindle in the low speed section.

Therefore, the number of output rotations of the driving motor 10 itself is maintained at a speed as high as possible while in the low speed section. It is possible to ensure a large transmission width of the spindle 40 and ensure as high an amount of torque output by the spindle 40 as possible with respect to the entire transmission width. Therefore, it is possible to efficiently grind a stone or the like with high torque while suppressing grinding powder or grind water from being scattered. This is accomplished by rotating the grindstone 41 at a low speed. Accordingly, the power tool 1 becomes more useful.

The continuously variable transmission mechanism 30 traction drive can continuously vary the number of revolutions of the spindle 40 in accordance with the type of machining, without causing a reduction in power (a reduction of the number of output rotations) of the driving motor 10. Therefore, the machining may be efficiently performed.

The power tool 1 includes the continuously variable transmission mechanism 30 that varies the rotational output of the driving motor 10 and a spindle 40 equipped with a front tool. The power tool typically has a structure with a driving motor 10 transmission, and a continuously variable transmission mechanism 30. In embodiments of the invention, it is possible to shift both the continuously variable transmission mechanism 30 and the driving motor 10, whereby the power tool 1 has a large transmission width.

Embodiments of this power tool 1 typically use a single operation member 13 that can shift both the continuously variable transmission mechanism 30 and the driving motor 10. Therefore, the operability of the power tool 1 may be enhanced.

When the speed of the spindle 40 is reduced, the continuously variable transmission mechanism 30 is adjusted before the driving motor 10 is adjusted. Therefore, the transmission width is shifted by the continuously variable transmission mechanism 30 and the driving motor 10, such that the number of rotations of the driving motor 10 is maintained at a speed as high as possible. Therefore, it is possible to ensure a large transmission width and ensure as high an output of torque of the spindle 40 as possible with respect to the entire transmission width.

When the driving motor 10 is used as a driving source of the power tool 1 and the number of rotations of the driving motor 10 decreases, the output torque also decreases. Therefore, the machining performance of the power tool 1 decreases and the work efficiency accordingly decreases. In this respect, the power tool 1 can rotate the front tool at a low speed and with a torque as high as possible. Therefore, it is possible to efficiently grind a stone or the like with high torque while rotating the grindstone at a low speed.

The power tool 1 preferably includes a of continuously variable transmission mechanism traction drive as the continuously variable transmission mechanism 30. Therefore, the number of revolutions of the spindle 40 is continuously varied in accordance with the type of machining involved. Preferably, the rotational torque (number of rotations) of the driving motor 10 is maintained. Accordingly, the power tool 1 can efficiently perform grinding.

Both the number of the rotations output from the driving motor 10 and the reduction ratio of the continuously variable transmission mechanism 30 correspond to the operation position of the single operation member 13.

Therefore, the number of rotations output from the continuously variable transmission mechanism 30 and the driving motor 10 are set to correspond to the operation position of a single operation member 13. Accordingly, by only changing of the operation position of the operation member 13, the optimum numbers of output rotations of the continuously variable transmission mechanism and the driving motor may be determined. Consequently, the number of revolutions of the spindle 40 is also determined.

While embodiments of the invention have been described with reference to specific configurations, it will be apparent to those skilled in the art that many alternatives, modifications and variations may be made without departing from the scope of the present invention. Accordingly, embodiments of the present invention are intended to embrace all such alternatives, modifications and variations that may fall within the spirit and scope of the appended claims. For example, embodiments of the present invention should not be limited to the representative configurations, but may be modified, for example, as described below.

The operation member 13 which shifts the continuously variable transmission mechanism 30 by varying the number of rotations of the driving motor 10 may be a turning dial, a lever, a slide or other suitable member. It may be possible to vary the number of rotations of the driving motor 10 in accordance with the pulling of a switch lever for starting the power tool, and to control shifting of the output shaft (spindle 40) by shifting the continuously variable transmission mechanism 30.

The power tool may be a disc grinder or appropriate power tool, such as a screw-tightening machine or an electric drill for boring. The power driving source may be an electric motor, as described above, or may be an air motor. The power tool may be an electric tool or an air tool.

This invention claims:

1. A power tool comprising:

a driving motor configured to output any number of output rotations;

a spindle equipped with a front tool;

a continuously variable transmission mechanism configured to seamlessly shift the number of the output rotations from the driving motor in any ratio and output the shifted number of the output rotations to the spindle;

a rotational speed of the spindle changed by both the shifted number of the output rotations of the driving motor and a changed ratio of the continuously variable transmission mechanism;

a low speed section of the spindle; and a high speed section of the spindle, wherein the rotational speed of the spindle in the high speed section is higher than the rotational speed of the spindle in the low speed section, reduction by the continuously variable transmission mechanism has priority over reduction of the driving motor when the rotational speed of the spindle is reduced in the high speed section, and the output rotations of the driving motor reduce the rotational speed of the spindle in the low speed section.

2. The power tool of claim 1 further comprising:

a single operation member configured to change the number of the output rotations of the driving motor, and to also change the ratio of the continuously variable transmission mechanism.

3. The power tool of claim 1 wherein the continuously variable transmission mechanism is a continuously variable transmission mechanism traction drive.

4. The power tool of claim 2, wherein both the number of the rotations of the driving motor and the ratio of the continuously variable transmission mechanism correspond to an operation position of the single operation member.

* * * * *